US007180060B2

(12) United States Patent
Chefetz et al.

(10) Patent No.: US 7,180,060 B2
(45) Date of Patent: Feb. 20, 2007

(54) E×B ION DETECTOR FOR HIGH EFFICIENCY TIME-OF-FLIGHT MASS SPECTROMETERS

(75) Inventors: Eli Chefetz, Ramat-Gan (IL); Armin Schon, Nes Ziona (IL)

(73) Assignee: El-Mul Technologies, Ltd., Yavne (IL)

( * ) Notice: Subject to any disclaimer, the term of this patent is extended or adjusted under 35 U.S.C. 154(b) by 0 days.

(21) Appl. No.: 10/901,092

(22) Filed: Jul. 29, 2004

(65) Prior Publication Data

US 2005/0056779 A1 Mar. 17, 2005

Related U.S. Application Data

(60) Provisional application No. 60/490,533, filed on Jul. 29, 2003.

(51) Int. Cl.
*H01J 49/00* (2006.01)

(52) U.S. Cl. ..... 250/291; 250/288; 250/397; 250/287; 250/282; 250/283; 313/105 CM; 313/103 CM

(58) Field of Classification Search ..... None
See application file for complete search history.

(56) References Cited

U.S. PATENT DOCUMENTS

| | | | | |
|---|---|---|---|---|
| 6,614,019 | B2 * | 9/2003 | Feller et al. | 250/287 |
| 2004/0227070 | A1 * | 11/2004 | Bateman et al. | 250/287 |
| 2004/0262531 | A1 * | 12/2004 | Gerlach et al. | 250/397 |

* cited by examiner

*Primary Examiner*—Nikita Wells
*Assistant Examiner*—Zia R. Hashmi
(74) *Attorney, Agent, or Firm*—Bacon & Thomas

(57) ABSTRACT

An ion detector having a planar electrically conducting entrance plate, a converter assembly including a planar electrically conducting converter plate and a converter member for providing free electrons upon impact of ions, a planar electrically conducting exit plate having an exit window, a magnet assembly, and an electron detection assembly. The planes of the converter plate and the entrance plate are parallel and electrically biasable in order to provide a homogeneous electric field. The magnet assembly provides a homogenous magnetic field between the converter plate and the exit plate, the magnetic field extending parallel to the plane of the converter plate. The ratio between the electric and the magnetic field is such that the electrons emitted from the converter plate travel to the exit window and are detected by the electron detection assembly.

16 Claims, 2 Drawing Sheets

E×B ION DETECTOR FOR HIGH EFFICIENCY TIME-OF-FLIGHT MASS SPECTROMETERS

This application claims the benefit of Domestic Priority under 35 U.S.C. § 119(e) based upon Provisional Application No. 60/590,533, filed Jul. 29, 2003.

FIELD OF THE INVENTION

Time-of-flight mass spectrometers (TOFMS) are used to identify the masses of very heavy molecular ions or clusters with masses reaching to several hundred thousand atomic mass units. Various techniques (e.g. MALDI) allow to generate low charge very heavy organic molecules or clusters. All these charged species will be denoted as ions. Typically in TOFMS a very short (sub ns) pulsed injection of the ions is accelerated to 2–30 kV and allowed to fly one to several meters in a straight line usually with an electrostatic reflector to add a return path to shorten the physical size of the instrument and to sharpen the time distribution.

BACKGROUND OF THE INVENTION

The time of arrival of the ions at an end plate is directly related to their M/q (mass to charge state ratio). In a typical application (10 kV acceleration and 2 m flight path) 7.2 ns separate the arrival time at the end plate of two adjacent mass ions (delta(M/q=1)) for M/q=10000 varying with the inverse square route of the mass of the ions. Due to thermal and lens effects there could be a spread of some cm in the radial extent normal to the direction of flight of the ions after traveling such distance, although they may have been emitted from a small spot. Thus, determination of the ion mass is based on a signal from the instance wherein the ions hit an extended end plane rather than a small focused spot. The efficient detection of these ions at the end plane with a time resolution sufficient to separate adjacent mass ions, even when the quantities of the adjacent ions vary, is a critical issue in the performance in any TOFMS. A typical distance in the forward direction separating traveling adjacent mass ions of M/q=10000 molecules upon their arrival at the detecting plane is 140 micrometer varying with the inverse square root of the mass. Therefore, the detecting plane has to be very flat and needs to be aligned perfectly perpendicular to the direction of flight to maintain the needed time resolution. Otherwise, there is a risk that ions with close by masses will hit the detecting surface at the same time.

A common detection scheme is to place a Micro-Channel-Plate (MCP) in the detection plane. The MCP has many channels each with diameter 5–20 microns and at an angle of 5–15 degrees to the normal. The open channels subtend 55–40% of the sensitive area of the MCP, the rest being the conducting area between the open channels. Thus, about 50% of the ions that hit the area between the channels are lost. Those impinging ions that hit an open channel can generate secondary electrons in the cannels that are further multiplied along the channel. There is some variation in timing of the initiation of the signals due to the different depth in the channel in which the ion hit the channel walls.

For the various ions that generate multiplication a train of pulses each of FWHM of 0.5–4 ns can be obtained in several ways:

By using a second MCP behind the first one followed by an anode. The train of pulses thus obtained from the anode has usually to be extracted from a high voltage level,or an additional screen at ground potential has to be introduced in front of the MCP input, so that the MCP input will be at about 2 kV, and the output at ground potential.

By accelerating the electrons from the first or second MCP towards a fast scintillating material and measuring the train of light pulses with a fast photo-multiplier tube (PMT).

Other arrangements involve a flat plate that the ions hit and generate electrons. The electrons are collected to some area usually to be further multiplied or amplified by an electron multiplier arrangement, or further accelerated towards a scintillating material. In such an arrangement, especially if the ion detecting area is of more than 1 cm in diameter, a significant time spread in the collection time of the electrons occurs due to the different flight path of the electrons. Also, some distortion of the electric field seen by the ions may be introduced effecting their arrival time to the detecting plate. In such arrangement the time resolution is usually worse than in the MCP arrangements.

Other TOFMS employ a combination of an electric field and a magnetic field to extract the secondary electrons and bring them to an electron detector such as MCP or scintillator. A. Brunelle et al., a group from the university of Orsay, France, disclose such a TOFMS in International Journal of Mass Spectrometry and Ion Processes 126, 65–73 (1993) (hereinafter Brunelle 1) and in Rapid Communications in Mass Spectrometry 11, 353–263 (1997) (hereinafter Brunelle 2) A similar system is disclosed by a group of the University of Delaware and Dupont in H. C. Michelle Byrd and C. N. McEwen, Analytical Chemistry 72, 4568–4576 (2000) (hereinafter Bird et al.) and C. N. McEwen, S. P. Thompson and V. C. Parr, A new Detector for Polymer Characterization by MALDI-TOF Mass Spectrometry. Proceedings of the 46 ASMS Conference for Mass Spectrometry and Allied Topics, Portland, Oreg., May 12–16, 1996; p 1072.

The TOFMS according to Brunelle comprises a ring extraction electrode to extract the electrons produced by ion impingement and a magnetic field after the extraction electrode (e.g. p 356 in Brunelle 2). The ring shaped extraction electrode used in Bruelle 2 introduces severe time variation for the ions passing through it. Thus, sufficiently high time resolution for a TOFMS cannot be obtained.

The device relied upon by the group from university of Delaware and Dupont (e.g. Bird et al., p 4570) also has an electron extraction field before the magnet. The detection path of the charged particles passes through screens 3 times (incoming ion, electron into the magnetic field region, electron from the magnetic field region towards the MCP detector). The electrons are subsequently detected by means of an MCP. As discussed above an MCP provides only limited efficiency, since for MCP 45% of the electrons that reach an MCP do not generate a signal. Additionally, every screen to be passed reduces the detection efficiency by 10–20% and generates secondary particle background.

SUMMARY OF THE INVENTION

In view of the above, it is an object to provide a detector for a TOFMS with improved time resolution and improved detection efficiency.

The principle idea of the invention is that electrons generated by the impinging ions hitting a flat most efficient converting area can be made to arrive at a fast electron detector with sub-ns time spread independent on their point of origin on the converting area. For this purpose, semi half circle electron trajectories are determined by a weak magnetic field normal to the ion motion, combined with an electric field in the direction of ion motion. Having traveled the semi half circle trajectories or sections thereof, the electrons pass through a transparent fine mesh in the detection plane, said mesh being laterally shifted away from the area of ion impact. Having passed through said mesh, the electrons are further accelerated from said mesh to an electron detector by an additional electric field.

Thus, the ion detector according to the present invention comprises a planar electrically conducting entrance plate, having an entrance window therein, said entrance window comprising a first transparent mesh;

a converter assembly comprising a planar electrically conducting converter plate and a converter member for providing efficient conversion of impacting heavy ions to secondary electrons, said converter member being supported by said converter plate, and said converter plate being easily replaceable;

a planar electrically conducting exit plate, having an exit window therein, said exit window optionally comprising a second transparent mesh;wherein the planes of the exit plate the converter plate and the entrance plate are parallel, the converter plate and the exit plate are facing the entrance plate, such that the converter member is aligned with the entrance window, wherein further the converter plate, the converter plate and the exit plate are electrically biased or biasable with respect to the entrance plate, in order to provide a homogeneous electric field between the converter plate and the exit plate, respectively and the entrance plate; the ion detector further comprising a magnet assembly for providing a homogeneous magnetic field in the space between the converter plate and the exit plate, respectively, and the entrance plate; wherein the magnetic field extends parallel to the plane of the converter plate, wherein the ratio between the electric field and the magnetic field is such that the electrons emitted from the converter plate are travelling to the exit window; and an electron detection assembly for detecting the electrons passing through said exit window.

It will be appreciated that the above design has significant advantages with respect to the device of Byrd et al. The number of meshes is decreased by one, because of the combination of the magnetic field and the electrical field in the same section of the path of the electrons. This results in an improved electron transmission. Moreover, the overall dimensions may be more compact, since no additional acceleration path is required for the electrons, before they enter the magnetic field.

According to one embodiment of the invention, the converter plate and the exit plate are arranged in one plane. This means also that they are on the same electrical potential. In this embodiment the converter plate and the exit plate may be provided as a single integral plate. In this design it is presently desired that the electron detection assembly provides an electrical field which leaks through the exit window in order to draw the arriving electrons therethrough. This is advantageous in order to limit the influence of the variation in emission energy of the electrons from the converter member on the time spread of the electrons passing through the exit window.

According to a second embodiment, the plane of the exit plate is spaced apart from the plane of the converter plate and slightly shifted towards the entrance plate, wherein the bias voltage of the exit plate is adjusted such that the electrical field between exit plate and the entrance plate is the same as the field strength between the converter plate and the entrance plate. Thus, electrons arriving at the exit plate have gained kinetic energy which corresponds to the difference in potential energy between the converter plate and the exit plate. In this embodiment the time jitter between different electrons transversing the exit plate grid will be minimized, because their transport trajectory through the mesh does not depend on the generally inhomogeneous leakage of the acceleration field between the mesh and the detector into the E×B field region. In order to keep the electrical field homogenous also in the region between the converter plate and the exit plate, and especially in order to isolate that region against field leakage from the acceleration field between the exit plate and the detector, this embodiment optionally contains a high resistance electrode connecting the converter plate and the exit plate such that a linearly decreasing surface potential is automatically created by the small currents flowing from one plate to the other.

The high resistance electrode preferably covers the whole distance between the two plates, in order to provide a linearly decreasing surface potential, therefore isolating this field region from possible distortions due to an acceleration field between the electron detector and the exit plate. Presently a ceramic material, such as alumina with a highly resistive coating or dopant, is the preferred material for the high resistance electrode.

The converter may comprise for example a thin film deposited on the converter plate or on a substrate which is mounted with the surface of the converter member in plane with the surface of the converter plate. Instead of a thin film a suitable sheet or plate can be employed as the converter member as well. The converter plate is chosen to have a high electron emission probability for impingement by heavy ions.

In one embodiment said thin film converter is boron-doped CVD diamond or submicron thick diamond films as described by R. Akhvlendiani et al in Diamond and Related Materials volume 11, page 545, 2002.

Said converter plate is integrated into the assembly such that it can be easily replaced by the MSTOF user, once the conversion efficiency has been reduced too much by the ion bombardment. Thus full detection efficiency can be restored by an easy and cost effective replacement of a consumable, rather than the replacement of a full detector.

The electron detection assembly comprises for example a fast scintillator material or a Micro-Channel Plate (MCP), wherein the MCP or the scintillator is biased with respect to the Exit window. Thus, the electrons are made to hit a fast scintillator connected to a fast photo-multiplier tube or to hit a Micro-Channel Plate with fast anode arrangement. Even thin plastic scintillators coated by aluminum can be used, as the electron rate in this arrangement for a typical mass spectrometer for heavy molecules is tolerable. A decoupling of the signal from the high voltages of the system is achieved by using the scintillator-PMT arrangement.

Since the converter member emits electrons with some spread of initial energy and direction, the area where the electrons arrive at the exit window is wider than the area on the converter member from where the electrons are emitted. Consequently, one embodiment of the invention which is presently considered has an exit window with a size larger than the size of the converter member.

According to a further aspect of the invention, a discriminator mesh may be provided in the path of the incoming ions before the entrance mesh and adjacent thereto, wherein the discriminator mesh is aligned with the entrance mesh. A small potential difference is provided between the discriminator mesh and the entrance mesh in order to repel secondary positive ions produced by the impact of the primary ions on the first mesh.

According to a still further aspect of the invention, pertaining to an embodiment wherein the electron detection assembly comprises an MCP-type detector, and wherein the plane of the exit plate is spaced apart from the plane of the entrance plate, the MCP-type detector is provided within the E×B field such that the secondary electrons impinge at its surface at the optimal energy for detection, typically some 200–500 eV. In this case the mesh in front of the secondary electron detector is not necessary and thus both overall transmission and detection efficiency for secondaries are improved.

Further aspects and advantages of the invention will be evident from the dependent claims the subsequent description of an embodiment and the drawings. Which show:

DESCRIPTION OF THE PREFERRED EMBODIMENTS

Figure 1:
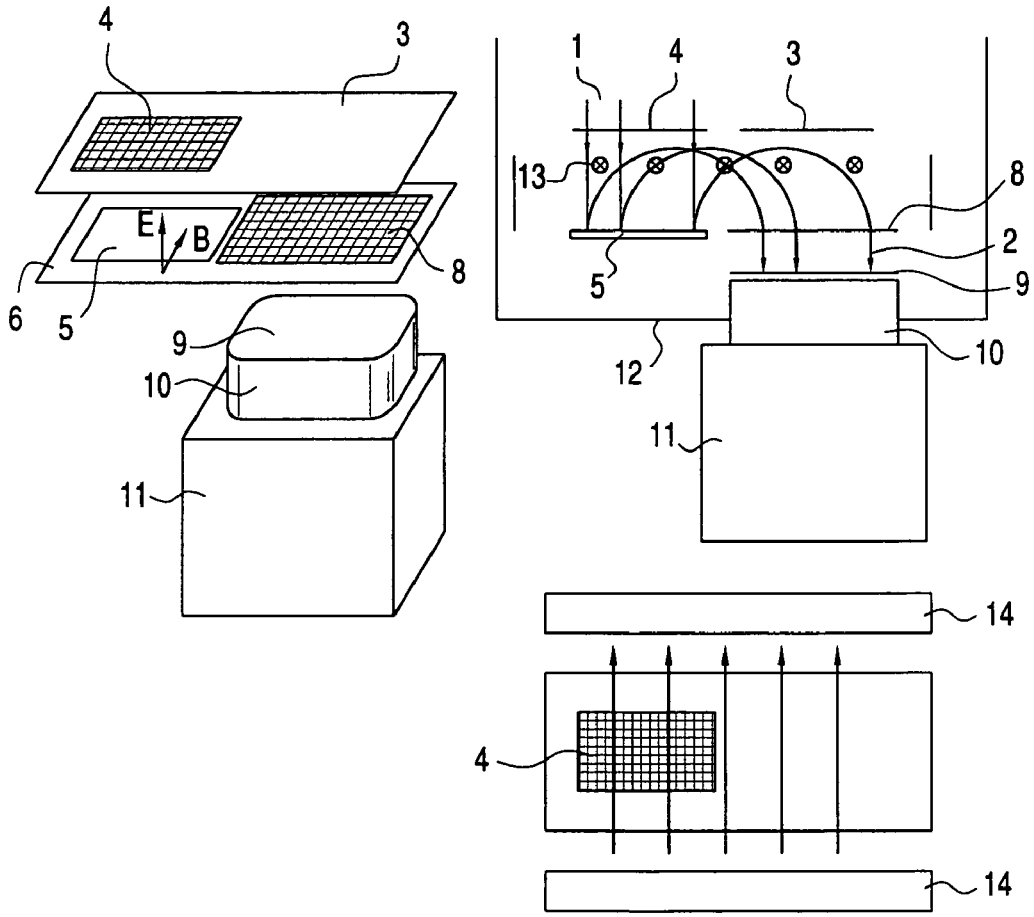
FIG. 1: an isometric view, side view, and top view of a first embodiment of a detector according to the present invention.

The ion detector for a TOFMS shown in FIG. 1, comprises a planar conducting entrance plate 3, said entrance plate comprising a first window with first a highly transparent metallic mesh 4. The transparent mesh is aligned with the trajectory of incoming ions 1, wherein the entrance plate 3 is oriented perpendicular to the axis of the ion beam. Typical transparency of the mesh can reach 90%. The mesh 4 is at the same potential V1 as the potential of a traveling tube of the ions (not shown). The ion detector further comprises a planar conducting conversion plate 6, wherein the conversion plate 6 comprises a converter member 5, which is aligned with the highly transparent metallic mesh 4. The planar converter member 5 comprises a material that has high electron emission probability per impinging ion such as CVD diamond or oxides or other materials known for their high secondary emission coefficients. The metallic mesh (4) and the converter member 5 subtend the area of the incoming ions. The detection plate 6 and the converter member 5 are at a potential V2, such that V2<V1 (electrons are accelerated from the converter member 5 towards the mesh 4.

The ion detector further comprises a DC homogeneous magnetic field 13 from a permanent or electromagnet 14, wherein the magnetic field 13 is set up between the entrance plate 3 and the conversion plate 6 parallel to the plates. Integrally with the conversion plate 6 is provided an exit plate with an exit window with a highly transparent exit mesh mesh 8. The exit mesh 8 is slightly larger in width and length compared with the converter member 5. The electric field between the entrance plate 3 and the detection plate 6 and the normal magnetic field 13 are designed to cause the electrons emitted from the converter member 5 to move in a semi-half circle path to the exit mesh 8. The equation of motion of the electrons and the required relationship between the voltages and the magnetic field are described below.

The ion detector according to the present invention further comprises a detector member 9, which is aligned with the exit mesh 8. Upon passing through the exit mesh 8 the electrons are further accelerated towards the detector member 9. If desired, the electrons from the exit mesh 8 that images the ion detecting area can be focused by a shaped electric field onto a smaller area on the detector member 9.

In the embodiment shown in FIG. 1 the detector member comprises a fast scintillating layer on top of a light guide 10 wherein the light is transmitted to a fast photo multiplier tube (PMT) 11. With a bias of about 10 keV between the second window and the scintillator a single electron produces over 50 photons in the scintillator. Since the signal path has been converted to an optical path from this stage on, the PMT 11 can be situated either in the vacuum chamber of the TOFMS or outside it.

The overall efficiency to detect ions can reach over 85% in such an arrangement as some ions are lost in the entrance mesh 4 and some electrons are lost in mesh 8, although if more than one electron is produced by the impinging ion that loss does have only a minimal effect on the detection efficiency. Nevertheless this is a significant improvement over the art according to Byrd et al. which comprised three meshes.

According to a further embodiment of the invention the detector member 9 comprises an MCP in position 9. This already results in an improved ion detection efficiency compared to designs without a converter member and an MCP in the position of the converter member of the device according to the present invention in all the cases where the impinging ion on the converter member 5 generates more than one electron.

According to a still further embodiment of the invention the ion detector comprises a discriminator mesh (not shown) which is matched and exactly aligned with the entrance mesh 4 in the ion path just before the entrance mesh 4. The alignment should be done in such a way that the transmission through both the discriminator mesh and the first mesh will not be reduced compared with a transition through the entrance mesh alone, e.g. by means of a mask aligner. A small potential difference between the discriminator mesh and the entrance mesh can repel any secondary positive ion produced by the impingement of the primary ion on the first mesh.

The equations of motion for the electrons generated upon ion impact by the converter member and traveling from the converter member to the exit mesh in the electric field and in the magnetic field between the conversion plate and the exit plate, respectively, and the entrance plate are given below:

The equation of motion for an electron in E×B fields

All units in MKS unless stated otherwise

E—electric field (V/m) normal to the conversion plate

B—magnetic field (Tessla)

V—Voltage (Volts) between entrance plate and the conversion plate and the exit plate, respectively m—mass of an electron (kg)

q—charge of the electron (esu)

m/q=5.686e−12 d—distance (m) between the entrance plate and the conversion plate and the exit plate, respectively x—length (m) in the direction parallel to the conversion plate and normal to the magnetic field y—length(m) in the direction normal to the conversion plate and the exit plate, respectively $v_x$,$v_y$—velocities (m/s) in the x,y directions $v_{x0}, v_{y0}$—initial electron velocities (m/s) from the emission point on the conversion plate.

Solution within non-relativtic limit $$1.\ m\frac{dv_y}{dt} = q\frac{V}{d} - qBv_x$$

$$2.\ m\frac{dv_s}{dt} = qBv_y$$

Initial conditions:

$$v_x(t=0)=v_{x0}$$

and $$v_y(t=0)=v_{y0}$$

The solution is $$3.\ v_x = \frac{V}{Bd} - D\cos(\omega t + \varphi)$$

$$4.\ v_y = D\ \sin(\omega t + \varphi)$$

$$\text{where } \tan\varphi = \frac{v_{y0}}{(V/Bd - v_{x0})};\ \omega = \frac{B}{(m/q)}$$

and $$D = \sqrt{v_{y0}^2 + (V/Bd - v_{x0})^2}$$

integrating from t=0 to t $$5.\ x = \frac{Vt}{Bd} - \frac{D(m/q)}{B}[\sin(\omega t + \varphi) - \sin\varphi]$$

$$6.\ y = \frac{D(m/q)}{B}[\cos\varphi - \cos(\omega t + \varphi)]$$

The following practical implications for the design of the ion detector may be derived from the above equations:

A half semi-circle is reached at time T when y comes back to 0 i.e $\omega T=2\pi$ leading to:

$$T(ns)_{at\ y=0}=357.3/B(\text{gauss}) \qquad 7.$$

At time T the electron reaches the exit plate after traversing the half semi-circle. This time is independent of the initial energy variation and angle of emission of the electron and depends only on B.

The magnetic field has to extend beyond $y_{max}$, the maximum distance from the detecting plane that is reached by the electrons. This occurs at time given by $wt+\phi=\pi$ $$8.\ y_{\max} = \frac{D(m/q)}{B}[\cos\varphi + 1]$$

The point where the half semi-circle of the electron trajectory hits the exit plate $x_{max}$ has to be greater than the length of the converter member L in the direction normal to the magnetic field. $x_{max}>L$. This is to allow for some separation between the converter member and the exit mesh through which the electrons pass to be further accelerated.

$$9.\ x_{\max}(\text{mm}) = 3.573\cdot 10^3\frac{V(V)}{B^2(gauss)d(\text{mm})}$$

Thus, the size of the converter member determines the ratio of the magnetic and electric field.

The distance between the conversion plate and the exit plate, respectively, and the entrance mesh or the the entrance plate d has to be greater than the maximum value of y $d>y_{max}$ where $$10.\ y_{\max} = \frac{5.686\cdot 10^{-12}D}{B}(1+\cos\varphi)\ (\text{note: } MKS \text{ units})$$

in the case of $$v_{x0}=v_{y0}=0$$

$$y_{max}=x_{max}/\pi$$

For initial energy $E_0$(eV) and direction of motion θ(deg)

$$v_{y0}(m/s) = 0.5935\cdot 10^{-6}\sqrt{E_0}\ \cos(0.01745\theta)\ v_{x0}(m/s) = 0.5935\cdot 10^{-6}\sqrt{E_0}\ \sin(0.01745\theta)$$

Resulting ratios between E and B fields and the related time of flight for the electrons between the converter member and the exit window are given for various geometries of $x_{max}$ and $y_{max}$ in table 1 below.

TABLE 1

Values of the magnetic field B(gauss) assuming d(mm) = $y_{max}$ + 3(mm)

| | | xmax(mm) | | | | |
|---|---|---|---|---|---|---|
| | | 20 | 30 | 40 | 50 | 60 |
| | | ymax(mm) | | | | |
| V(Volt) | | 6.4 | 9.5 | 12.7 | 15.9 | 19.1 |
| 300 | B(gauss) | 75.6 | 53.4 | 41.3 | 33.7 | 28.4 |
| | T(ns) | 4.7 | 6.7 | 8.7 | 10.6 | 12.6 |
| 500 | B(gauss) | 97.6 | 68.9 | 53.3 | 43.5 | 36.7 |
| | T(ns) | 3.7 | 5.2 | 6.7 | 8.2 | 9.7 |
| 1000 | B(gauss) | 138.1 | 97.4 | 75.3 | 61.5 | 51.9 |
| | T(ns) | 2.6 | 3.7 | 4.7 | 5.8 | 6.9 |
| 3000 | B(gauss) | 239.2 | 168.7 | 130.5 | 106.4 | 89.9 |
| | T(ns) | 1.5 | 2.1 | 2.7 | 3.4 | 4.0 |
| 10000 | B(gauss) | 436.7 | 308.0 | 238.3 | 194.3 | 164.1 |
| | T(ns) | 0.8 | 1.2 | 1.5 | 1.8 | 2.2 |

Figure 2:
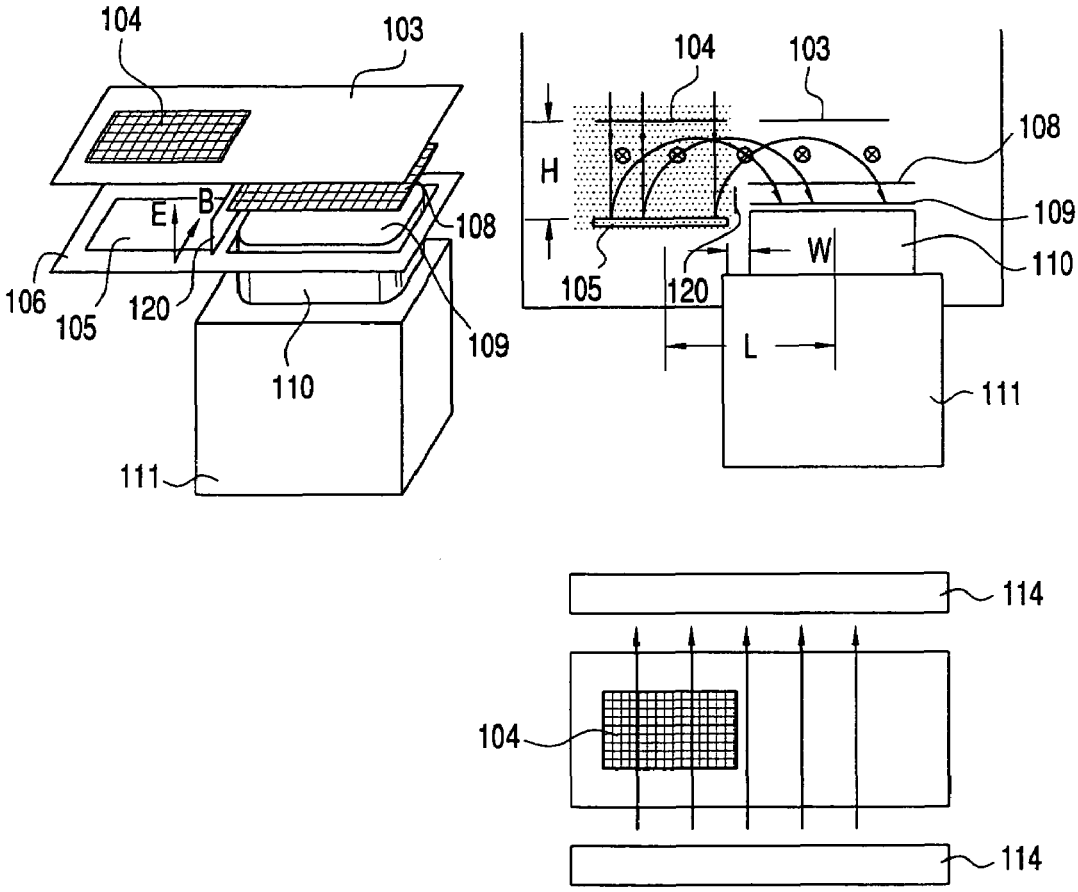
FIG. 2: an isometric view, side view, and top view of a second embodiment of a detector according to the present invention.

FIG. 2 shows a second embodiment of the detector according to the present invention. The overall structure of the second embodiment corresponds to the structure of the first embodiment. In order to identify the corresponding components in FIGS. 1 and 2, respectively, reference numerals of components shown in FIG. 2. are equal to 100+n, wherein n is the reference numeral of the corresponding component in the embodiment according to FIG. 1, e.g. the highly transparent mesh 4 of FIG. 1 corresponds to the highly transparent mesh 104 of FIG. 2. With this in mind, the general description of the first embodiment applies to, the second embodiment as well, mutatis mutandis. The few differences between the two embodiments are explained below.

The most important difference is the position of the exit plate 108 which is located in a plane which is spaced apart from the plane of the conversion plate 106, wherein the exit plate 108 is slightly shifted towards the entrance plate 103. In order to obtain a homogeneous electric field between the entrance plate 103 and the conversion plate 106 and the exit plate 108, the exit plate 108 is biased with respect to the conversion plate 106, wherein the bias voltage depends on the offset of the plane of the exit plate 108, with respect to the plane of the conversion plate 106. The difference between the bias voltages of the exit plate 108 and the conversion plate 106 conrresponds to the kinetic energy gained by the secondary electrons which are generated on the conversion plate and which travel on semi hallf circle trajectories towards the exit plate 108 and through the exit window therein. The second embodiment further comprises a high resistance electrode 120 with a homogeneously highly resistive planar surface. Thus the voltage drop between the converter plate 106 and the exit plate 108 is linear across the surface of the electrode 120. The electrode 120 is arranged with its surface perpendicular to the plane of the exit plate and preferably parallel to the magnetic field. The electode 120 comprises for instance a base plate of alumina with a suitable coating, e.g. a coating comprising a chromium oxide. The electrode 120 further serves the purpose to shield the region which is confined by the the converter plate 105 and the plane of the electrode 120 from perturbations by accelerating voltages applied between the exit plate and the electron detection assembly.

All electron detection assemblies discussed with respect to the embodiment of FIG. 1 are suitable for the embodiment of FIG. 2 as well. However, for an embodiment with an MCP-type detector, the following further option should be considered. If the exit plate 108 is placed at such a plane in the E×B-Field that the kinetic energy gained by the electrons between the conversion plate 106 and the exit plate 108 is suitable for ideal performance of the MCP, the surface of the MCP detector shown at 109 may be placed on the same potential as the exit plate. Hence, the surface plane of the MCP may coincide or may be placed in close proximity behind the plane of the exit plate. In this case there would be no need that the exit window comprises a mesh. The omission of the mesh would further increase the detection efficiency of secondary electrons.

The invention claimed:

1. An ion detector, comprising:

a planar electrically conducting entrance plate, having an entrance window therein, said entrance window comprising a first transparent mesh;

a converter assembly comprising a planar electrically conducting converter plate and a converter member for providing free electrons upon impact of ions, said converter member being supported by said converter plate;

a planar electrically conducting exit plate, having an exit window therein;

a magnet assembly for providing a homogeneous magnetic field in the space between the converter plate and the exit plate, respectively, and the entrance plate; and an electron detection assembly for detecting the electrons passing through said exit window, wherein:

the planes of the exit plate the converter plate and the entrance plate are parallel, the converter plate and the exit plate are facing the entrance plate, such that the converter member is aligned with the entrance window, further the converter plate, the converter member and the exit plate are electrically biasable with respect to the entrance plate, in order to provide a homogeneous electric field between the converter plate and the exit plate, respectively and the entrance plate, the magnetic field extends parallel to the plane of the converter plate, and the ratio between the electric field and the magnetic field is such that the electrons emitted from the converter plate are traveling to the exit window.

2. The ion detector according to claim 1, wherein:

said converter plate and said exit plate are arranged in one plane, and said converter plate and said exit plate are at the same electrical potential.

3. The ion detector according to claim 1, wherein:

the plane of said exit plate is spaced apart from the plane of said converter plate and shifted towards said entrance plate.

4. The ion detector according to claim 3, wherein:

the bias voltage of said exit plate is adjusted such that the field strength of the electrical field between said exit plate and said entrance plate is the same as the field strength between said converter plate and said entrance plate.

5. The ion detector according to claim 1, wherein:

said converter member comprises a thin film deposited on a substrate.

6. The ion detector according to claim 1, wherein:

said converter member comprises a sheet or plate of a converting material that can be replaced upon damage caused by impinging ions.

7. The ion detector according to claim 1, wherein:

said converter member comprises a material with high secondary electron coefficient for heavy ions, such as a sub-micron layer of CVD diamond, a layer of boron doped CVD diamond, aluminum-oxide, cesiated thin oxide layer, oxidized steel layer or stainless steel.

8. The ion detector according to claim 1, wherein:

said electron detection assembly comprises either a fast scintillator material or a Micro-Channel Plate (MCP).

9. The ion detector according to claim 1, wherein:

said magnetic field encompasses the area of said converter member.

10. The ion detector according to claim 1, wherein:

the magnetic and electric fields are tunable.

11. The ion detector according to claim 3, further comprising:

an electrode, between said converter plate and said exit plate, said electrode having a highly resistive surface which is aligned perpendicular to the plane of said converter plate.

12. The ion detector according to claim 11, wherein:

said electrode comprises a ceramic base material, especially alumina, and a resistive coating thereon.

13. The ion detector according to claim 3, wherein:

said electron assembly comprises an MCP-type detector, and the surface of the MCP-type detector is placed within the homogeneous E×B-field at such a position that the bias voltage corresponding to this position provides the required kinetic energy for optimized detection efficiency for electrons emitted from said converter plate.

14. The ion detector according to claim 1, wherein:

said exit window, comprises a second transparent mesh.

15. The ion detector according to claim 13, wherein:

said exit window, comprises an open aperture without a second transparent mesh therein.

16. The ion detector according to claim 15, wherein:

the entrance surface of said MCP is placed in said aperture of said exit window.

* * * * *